United States Patent [19]

Wheless

[11] Patent Number: 4,875,495

[45] Date of Patent: Oct. 24, 1989

[54] SEPARATION OF LIGHT PARTICLES FROM HEAVY PARTICLES IN A STREAM OF PARTICULATE MATTER

[75] Inventor: Jack C. Wheless, Richmond, Va.

[73] Assignee: Philip Morris Incorporated, New York, N.Y.

[21] Appl. No.: 85,868

[22] Filed: Aug. 14, 1987

[51] Int. Cl.[4] ..... A24C 5/39

[52] U.S. Cl. ..... 131/110; 131/84.3

[58] Field of Search ..... 131/84.3, 110, 109.1, 131/169.2

[56] References Cited

U.S. PATENT DOCUMENTS

| | | | |
|---|---|---|---|
| 3,030,965 | 4/1962 | Labbe . | |
| 3,034,514 | 5/1962 | Pinkham | 131/84.3 |
| 3,092,117 | 6/1963 | Labbe . | |
| 4,288,318 | 9/1981 | Essman et al. . | |
| 4,526,182 | 7/1985 | Labbe | 131/110 |
| 4,553,555 | 11/1985 | Cox | 131/110 |

*Primary Examiner*—V. Millin

*Attorney, Agent, or Firm*—Jeffrey H. Ingerman

[57] ABSTRACT

A method and apparatus for separating light particles from heavy particles in a stream of particulate matter, particularly for separating stems from the stream of tobacco filler fed to a cigarette maker, is provided. The tobacco is introduced into a first chamber in which it travels generally downward to a fourth chamber communicating with second and third chambers, the second chamber being the chimney of the cigarette maker and the third chamber extending downward from the fourth chamber. An air stream flowing upward through the third chamber reverses the momentum of most of the light particles and propels them into the chimney, while the heavy particles (stems) and some light particles travel downward into the third chamber. As the light particles fall through the third chamber, their momentum is gradually reversed by the air stream and they rise through the fourth chamber into the chimney. The heavy particles are collected at the bottom of the third chamber.

7 Claims, 1 Drawing Sheet

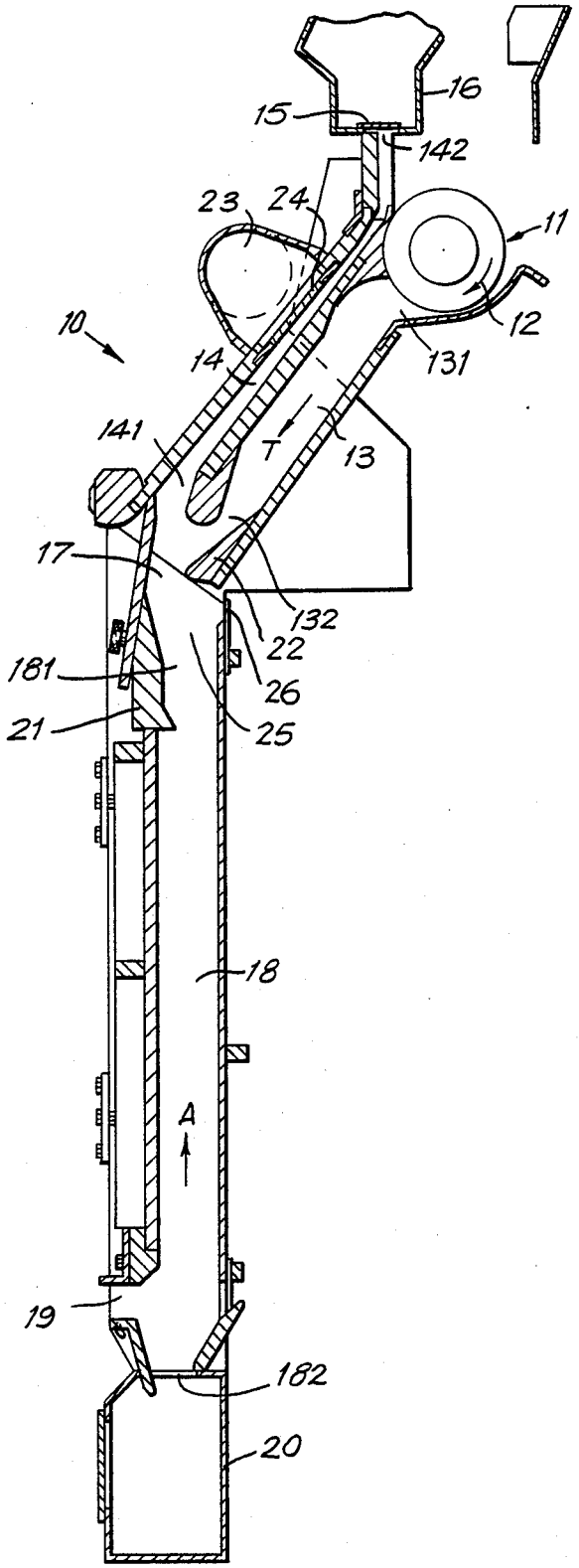
16
15
142
23
24
11
12
10
14
131
141
T
13
17
132
22
181
26
21
25
18
A
19
182
20

SEPARATION OF LIGHT PARTICLES FROM HEAVY PARTICLES IN A STREAM OF PARTICULATE MATTER

BACKGROUND OF THE INVENTION

This invention relates to the separation of light particles from heavy particles in a stream of particulate matter. In particular, this invention relates to the separation of stems from tobacco filler in a cigarette maker.

In the manufacture of cigarettes, tobacco filler is produced by essentially shredding, as by multiple slitting, cured tobacco leaf. The whole leaf contains stems and large veins which are undesirable in cigarette filler because they burn unevenly and may protrude through the cigarette wrapper. Thus, care is taken to try to remove as much of the stems and veins as possible before the leaf is cut. After cutting, additional steps are taken to remove any stems and veins that may remain in the cut filler. However, some fraction of the stems and veins remain as the filler is transported to the cigarette maker.

Tobacco filler is introduced into conventional cigarette makers in a section referred to as the chimney, in which it falls against a rising current of air which carries it upwards to a perforated tape, usually steel, to which suction is applied from above. The tape continually moves horizontally, carrying the accumulated filler to subsequent sections of the cigarette maker.

It is known to provide for separation of stems and other heavy particles from the filler in the chimney. For example, it is known to provide a separation chamber below the chimney and to introduce the filler horizontally at the top of the separation chamber. A current of air rises through the separation chamber and into the chimney, carrying with it primarily light particles, although a small proportion of heavy particles are carried upwards as well. The remaining heavy particles, and some light particles, fall downward through the separation chamber. Some of the light particles slow and reverse direction as they travel against the direction of the air stream in the separation chamber, eventually rising into the chimney. The remaining light particles and the heavy particles exit at the bottom of the separation chamber. However, such systems allow some heavy particles to enter the chimney, and also allow some desirable light particles to be rejected.

It would be desirable to be able to provide a method and apparatus for separating heavy particles from a stream of particulate matter without separating any significant amount of light particles, and especially a method and apparatus for separating stems from tobacco filler in a cigarette maker.

SUMMARY OF THE INVENTION

It is an object of this invention to provide a method and apparatus for separating heavy particles from a stream of particulate matter without separating any significant amount of light particles, and especially a method and apparatus for separating stems from tobacco filler in a cigarette maker.

In accordance with this invention there is provided apparatus for separating heavy particles (such as stems) from light particles in a stream of particulate matter (such as tobacco filler). The apparatus has a first elongated chamber into which the stream of light and heavy particles is introduced and in which the stream travels generally in the direction of gravity. There is a second elongated chamber in which light particles travel against the direction of gravity and from which heavy particles are substantially absent. There is also a third elongated chamber in which the heavy particles and a first portion of the light particles travel simultaneously in the direction of gravity and in which a second portion of the light particles travel against the direction of gravity. Each chamber has first and second ends. The second end of the first chamber meets and communicates with the first ends of the second and third chambers at a fourth chamber. A stream of fluid is provided at the second end of the third chamber and is accelerated against the direction of gravity, causing reversal of the momentum of a third portion of the light particles exiting the first elongated chamber at the fourth chamber, such that the third portion of light particles enters the second elongated chamber. The stream also causes reversal of the momentum of substantially all of the first portion of light particles as they travel toward the second end of the third elongated chamber, such that substantially all of the first portion of light particles become the second portion of light particles and travel toward the fourth chamber and into the second elongated chamber. The heavy particles exit the second end of the third elongated chamber.

A separation method implemented by the apparatus is also provided.

BRIEF DESCRIPTION OF THE DRAWING

The above and other objects and advantages of the invention will be apparent upon consideration of the following detailed description, taken in conjunction with the accompanying FIGURE, which is a side cross-sectional view of the chimney section of a cigarette making machine incorporating the invention.

DETAILED DESCRIPTION OF THE INVENTION

The FIGURE shows the chimney section 10 of a conventional cigarette maker, such as a Protos® cigarette maker manufactured by Hauni-Werke Korber AG, which has been modified according to this invention.

Tobacco filler containing both light particles of shredded tobacco and heavy particles such as stems is fed in at 11. The tobacco filler is accelerated by accelerator roller 12 into a first elongated chamber 13 having a first end 131 and a second end 132. Second elongated chamber 14, having first end 141 and second end 142, is a conventional chimney having at second end 142 a perforated suction tape 15 and a suction box 16 applying suction from above tape 15. First and second chambers 13, 14 meet and communicate at a fourth chamber 17. A third elongated chamber 18, having first and second ends 181, 182, also meets and communicates with first and second chambers 13, 14 at fourth chamber 17.

A fan 23 or other source of vacuum applies suction at 24. A supply of air for suction fan 23 is fed into chamber 18 at 19, travelling up chamber 18 in the direction of arrow A, and into chamber 17 at 25 (against the direction of gravity). The suction applied at 24 and the air supplied at 19 provide the air flow necessary for operation of the invention. Suction box 16 applies only enough suction to carry the tobacco from point 24 to suction tape 15. An adjustable vent 26 at point 25 is used to adjust the air velocity in chambers 17, 18. As vent 26 is opened, the velocity in chamber 17 increases, but the velocity in chamber 18 decreases because less of the total air flow is provided through chamber 18.

The tobacco filler accelerated into chamber 13 by roller 12 travels in a stream shown by arrow T through chamber 13 which slopes generally downward (generally in the direction of gravity) until it enters chamber 17. At that point all particles, heavy and light, have a generally downward momentum. The velocity of the stream of air A travelling upward into chamber 17 from chamber 18 is chosen so that stream A is sufficient to reverse the momentum of the light particles in the stream of tobacco T, but not the heavy particles (the exact velocity is dependent on the condition of the tobacco, mainly its density which is affected by its moisture content, and also on the particle size), propelling the light particles into a chimney chamber 14. Chimney chamber 14 operates in the normal way, carrying the light particles up to tape 15, which accumulates the tobacco and carries it to subsequent sections of the cigarette maker (not shown).

In practice, not all of the light particles in tobacco stream T are propelled into chimney chamber 14. Some descend into chamber 18 with the heavy particles, substantially in the direction of gravity. However, chamber 18 is made to be of such a length, (e.g., approximately 24 inches for a modified Protos® cigarette maker), that substantially all of the light particles entering chamber 18 reverse their direction under the influence of air stream A before reaching end 182 of chamber 18, and rise back up to chamber 17 where they are propelled into chimney chamber 14. The heavy particles continue downward, and are collected in receptacle 20.

An insert 21 is provided to narrow chamber 17, thus increasing the velocity of air stream A in chamber 17 and maximizing the number of light particles whose momentum is reversed. Deflector 22 is provided just below the second end 132 of chamber 13 to aid in slowing tobacco particles and in narrowing chamber 17.

The downward direction of the tobacco particles as they exit chamber 13 minimizes the number of heavy particles (e.g., stems) that are propelled into chimney chamber 14. While in previously known apparatus it was necessary only for the air stream to change the direction of motion of the particles from horizontal to vertical, in the present invention the air stream must actually reverse the momentum of the particles, decreasing the number of heavy particles which enter chimney chamber 14.

Similarly, in chamber 18 an upward air stream reverses the direction of light particles that were not originally propelled into the chimney. Chamber 18 is long enough to allow recovery of substantially all light particles, resulting in increased efficiency over systems with shorter chambers in which desirable tobacco either was wasted or had to be recovered for re-use.

Thus, it is seen that an improved chimney section for a cigarette maker is provided for separating light particles from heavy particles in a stream of tobacco fed to the cigarette maker. One skilled in the art will appreciate that the present invention can be practiced by other than the disclosed embodiment, which is presented for purposes of illustration and not of limitation, and the present invention is limited only by the claims that follow.

What is claimed is:

1. Apparatus for separating heavy particles from light particles in a stream of particulate matter, said apparatus comprising:

a first elongated chamber into which said stream containing said light and heavy particles is introduced and in which said stream travels generally in the direction of gravity, said first elongated chamber having a first end and a second end;

a second elongated chamber in which said light particles travel against the direction of gravity and from which said heavy particles are substantially absent, said second elongated chamber having a first end and a second end;

a third elongated chamber in which said heavy particles and a first portion of said light particles travel generally in the direction of gravity and in which a second portion of said light particles travels against the direction of gravity, said third elongated chamber having a first end and a second end;

a fourth chamber at which said second end of said first elongated chamber, said first end of said second elongated chamber, and said first end of said third elongated chamber communicate with one another; and means adjacent said second end of said third elongated chamber for providing a stream of fluid in said chamber, said stream for fluid being accelerated against the direction of gravity, such that particles in said third chamber are subject to acceleration by said stream of fluid against the direction of gravity at substantially all times during their passage through said third chamber; whereby:

said stream of fluid causes reversal of the momentum of a third portion of said light particles exiting said first elongated chamber into said fourth chamber such that said third portion of said light particles enters said first end of said second elongated chamber, and causes reversal of the momentum of substantially all of said first portion of said light particles as said first portion of said light particles travels toward said second end of said third elongated chamber such that substantially all of said first portion of said light particles become said second portion and travel toward said fourth chamber and into said second elongated chamber, said heavy particles exiting said second end of said third elongated chamber beyond said fluid stream providing means.

2. Apparatus for separating heavy particles from light particles in a stream of tobacco filler entering the chimney section of a cigarette maker, said chimney section having at the top thereof a perforated suction tape for accumulating tobacco filler and transporting it to subsequent sections of said cigarette maker, said apparatus comprising:

a first elongated chamber into which said stream of tobacco filler containing said light and heavy particles is introduced and in which said stream of tobacco travels generally in the direction of gravity, said first elongated chamber having a first end and a second end;

a second elongated chamber in which said light particles travel against the direction of gravity and from which said heavy particles are substantially absent, said second elongated chamber having a first end and a second end, said perforated tape being at said second end of said second elongated chamber;

a third elongated chamber in which said heavy particles and a first portion of said light particles travel substantially in the direction of gravity, and in which a second portion of said light particles travels against the direction of gravity, said third elongated chamber having a first end and a second end;

a fourth chamber at which the second end of said first elongated chamber, said first end of said second elongated chamber and said first end of said third elongated chamber communicate with one another; and means adjacent said second end of said third elongated chamber for providing a stream of air in said chamber, said stream of air being accelerated against the direction of gravity, such that particles in said third chamber are subject to acceleration by said stream of air against the direction of gravity at substantially all times during their passage through said third chamber; whereby;

said stream of air causes reversal of the momentum of a portion of said light particles at said fourth chamber, such that said light particles enter said first end of said second elongated chamber, and causes reversal of the momentum of substantially all of said first portion of said light particles as said light particles travel toward said second end of said third elongated chamber, such that substantially all of said first portion of said light particles become said second portion and travel toward said fourth chamber and into said second elongated chamber, said heavy particles exiting said second end of said third elongated chamber beyond said air stream providing means.

3. The apparatus of claim 2 further comprising means for increasing the velocity of said stream of air as it approaches said fourth chamber.

4. The apparatus of claim 3 wherein said velocity increasing means comprises means for restricting the width of said fourth chamber adjacent said third elongated chamber.

5. The apparatus of claim 4 further comprising deflector means in said fourth chamber for slowing tobacco particles, said deflector means cooperating with said restriction means to further increase said velocity.

6. The apparatus of claim 2 further comprising deflector means in said fourth chamber for slowing tobacco particles.

7. A method for separating heavy particles from light particles in a stream of particulate matter, said method comprising the steps of:

providing first, second and third elongated chambers each having a first end and a second end, said second end of said first elongated chamber and said first ends of said second and third elongated chambers communicating at a fourth chamber;

introducing a stream of particulate matter, including light and heavy particles, into said first end of said first elongated chamber such that said stream travels generally in the direction of gravity toward said fourth chamber; and introducing a stream of fluid in said third elongated chamber adjacent said second end thereof, said stream of fluid being accelerated against the direction of gravity, such that particles in said third chamber are subject to acceleration by said stream of fluid against the direction of gravity at substantially all times during their passage through said third chamber; whereby:

said stream of fluid causes reversal of the momentum of a portion of said light particles in said fourth chamber such that said light particles enter said first end of said second elongated chamber, and causes reversal of the momentum of substantially all of the remainder of said light particles as said remainder of said light particles travels from said fourth chamber toward said second end of said third elongated chamber such that substantially all of said remainder of said light particles travel toward said fourth chamber and into said second elongated chamber, said heavy particles exiting said second end of said third elongated chamber beyond where said stream of fluid is introduced.

* * * * *